US005546862A

United States Patent [19]

Schabdach

[11] Patent Number: 5,546,862

[45] Date of Patent: Aug. 20, 1996

[54] REMOTE CONTROL ADAPTOR FOR A DETONATOR SYSTEM

[75] Inventor: Paul G. Schabdach, Churchville, Md.

[73] Assignee: The United States of America as represented by the Secretary of the Army, Washington, D.C.

[21] Appl. No.: 375,336

[22] Filed: Jan. 19, 1995

[51] Int. Cl.[6] ..... F42D 3/00

[52] U.S. Cl. ..... 102/302; 102/200; 102/303

[58] Field of Search ..... 102/302, 200, 102/303

[56] References Cited

U.S. PATENT DOCUMENTS

| | | | |
|---|---|---|---|
| 4,576,093 | 3/1986 | Snyder | 102/200 |
| 4,750,424 | 6/1988 | Hau | 102/200 |
| 4,817,529 | 4/1989 | Schippers | 102/302 |
| 5,107,765 | 4/1992 | Schippers | 102/302 |
| 5,185,528 | 2/1993 | Gordon | 102/200 X |
| 5,488,908 | 2/1996 | Gilpin et al. | 102/200 |

*Primary Examiner*—Peter A. Nelson

*Attorney, Agent, or Firm*—Edward Goldberg; Michael C. Sachs; Edward L. Stolarum

[57] ABSTRACT

A remote control adaptor for the XM-122 detonator system which utilizes a pair of color coded LED's to indicate the open or closed status of the output terminal of a bistable relay.

8 Claims, 1 Drawing Sheet

REMOTE CONTROL ADAPTOR FOR A DETONATOR SYSTEM

GOVERNMENT INTEREST

The invention described herein may be manufactured, used and licensed by or for the U.S. Government.

BACKGROUND OF THE INVENTION

Ordnance personnel have a need to test weapon and munition effectiveness against the latest improvements made in the armor of tanks and personnel carriers. They normally have to perform these tasks under conditions which simulate battlefield conditions. Under live fire conditions test personnel must be protected from physical injury. Teams of ordnance personnel frequently are required to travel to different testing sites to operate smoke producing equipment in order to provide a smoke screen for the testing of the military hardware. Where there is no danger to operating personnel the smoke generators are operated from an on-board control panel. They may also be initiated by remote operation by either the use of a hard wire control system or a radio remote system.

In the past a demolition firing device which generates an electrical impulse detonation signal at its output was used to detonate explosive smoke generators. Live fire testing precludes the use of on-board controls since ordnance operations are not allowed in the target area. When smoke generators are inside a target area ordnance operation are not able to use bard wired remote controls, thus dictating the use of a wireless system.

SUMMARY OF THE INVENTION

The present invention relates to a device which converts the demolition firing device into a remote control actuator.

An object of the present invention is to convert the demolition firing device to remotely control smoke generators.

An other object of the present invention is to permit modification of a demolition firing device previously used only to set off blasting caps to remotely control smoke generators or any other device or system.

A further object of the present invention is to provide a remote control adaptor for a detonator system which allows the user to determine in advance by visual signal whether its output terminals are open or closed.

For a better understanding of the present invention, together with other and further objects thereof, reference is made to the following description taken in connection with the accompanying drawings.

DETAILED DESCRIPTION OF THE PREFERRED EMBODIMENT

Figure 1:
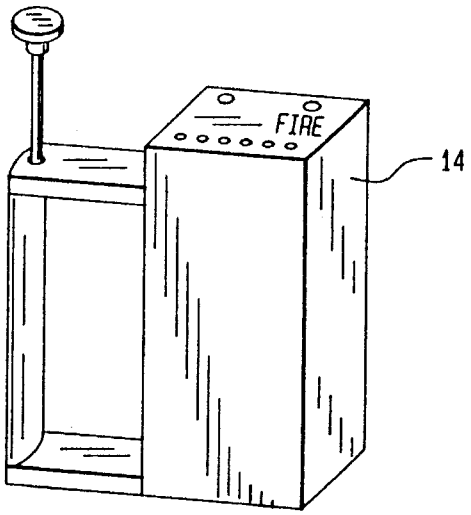
FIG. 1 is an isometric view of the transmitter of a demolition firing device.
Figure 2:
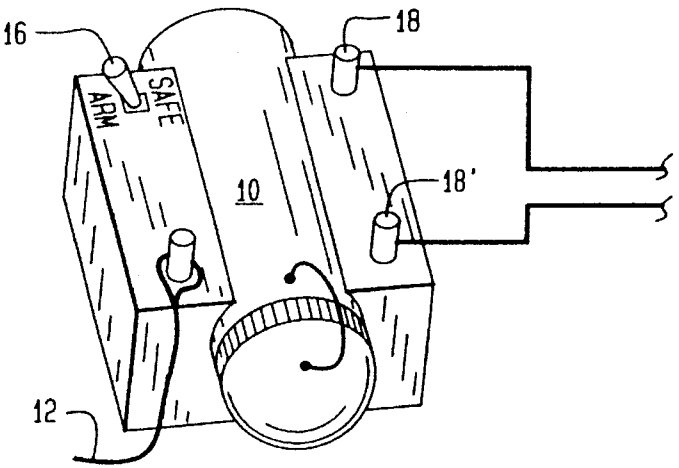
FIG. 2 is an isometric view of the receiver of a demolition firing device.

The prior art demolition firing device consists of a transmitter shown in FIG. 1 and ten receiver units, one of which is represented in FIG. 2. The receiver unit 10 receives an RF signal via antenna 12 from the transmitter 14 when the transmitter is activated and when toggle switch 16 is moved from a "safe" position to an "arm" position. The receiver 10 delivers an output signal on its output terminals 18, 18' that is of sufficient strength to detonate explosives in a well known manner. By use of the remote control adaptor shown in FIG. 3, the prior art demolition firing device is adapted to control smoke generators and other devices which are operated by the closure of a self-powered circuit rather than by the application of a detonation signal.

Figure 3:
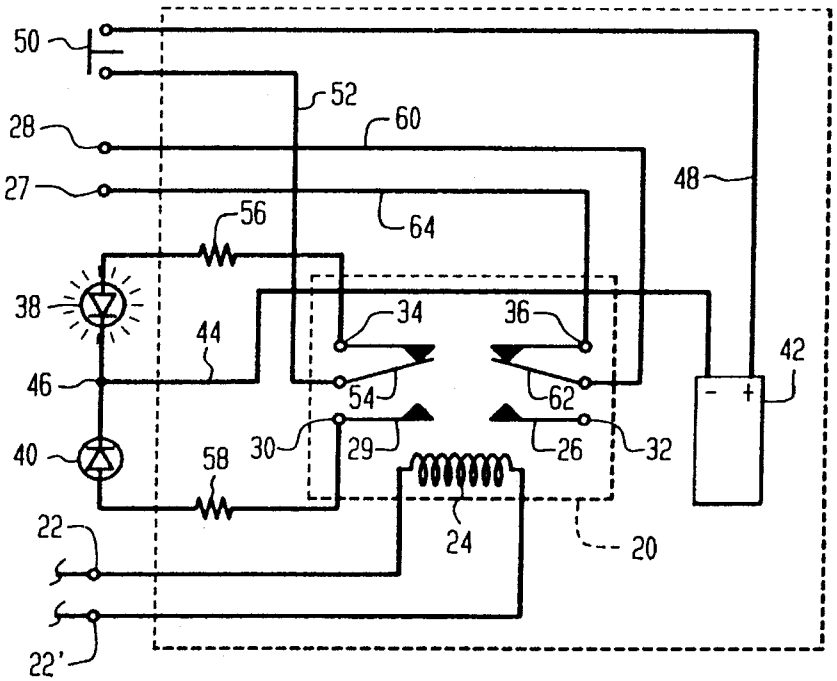
FIG. 3 is an electrical schematic of the remote control adaptor in accordance with the present invention.

Referring now to FIG. 3, the adaptor circuit comprises a bistable impulse relay 20 such as made by Potter and Brumfield, Model Number S89R11DAC1-24 which acts as a double Dole double throw switch. The output terminals 18, 18' of receiver 10 are connected to the input terminals 22, 22' of solenoid coil 24. Everytime there is a sufficient impulse signal on terminals 22, 22', the output of switches 26 and 29 will toggle between an open and closed position. FIG. 3 shows the switches 26 and 29 in their closed position. The device or smoke generator to be operated remotely is connected across output terminals 27 and 28. The closing of switch 26 as shown in FIG. 3 turns on the device connected to output terminals 27 and 28. Relay switches 26 and 29 will remain in this position until there is another impulse to the input terminals 22 and 22'. Since it is desirable to connect the device to output terminals 27 and 29 when switch 26 is in the open position, it is important to know this before hand. In the prior art device it was not possible to visably determine the condition of the output terminals of the receiver. In order to determine if relay switch 26 is in fact open, switch 29 is wired to operate the same as switch 26, that is relay 29 contact 30 is open at the same time as relay 26 contact 32 is open and contact 34 is closed at the same time as contact 36 is closed.

In operation relay switch 29 is used to operate two light emitting diodes (LED's) 38 and 40. When LED 39 is operational or "red" it indicates that relay switches 26 and 29 are in their closed position. If diode 40 is operational or "green", then the observer will know that relay switches 26 and 29 are in their open positions. A 9 volt battery 42 has its negative terminal electrically connected by connector 44 to the common junction 46 of the cathodes of LED's 38 and 40. The positive terminal of battery 42 is connected via conductor 48 to one side of a normally open momentary pushbutton switch 50. The other side of pushbutton switch 50 is connected via conductor 52 to the center arm 54 of relay 29. Relay 29 has its contact 34 connected through a current limiting resistor 56 to the anode of red LED 38. Relay 29 has its contact 30 electrically connected through a current limiting resistor 59 to the anode terminal of the green LED 40. Electrical conductor 60 connects the center arm 62 of relay 26 to the output terminal 28. Electrical conductor 64 connects contact 36 of relay 26 to the output terminal 27. As previously stated, the operation of relay 29 is identical to relay 26. A lit red LED 38 means the output terminals 27 and 28 are closed. A lit green LED 40 means that the output terminals are open. The external device or smoke generator to be operated is connected to the output terminals 27 and 28 of the remote control adaptor when the output terminals 27 and 28 are in their open position. When relay switch 26 is closed as shown in FIG. 3, the device connected to output terminals 27 and 28 will be operated. The normally open momentary pushbutton switch 60 is included in the circuit of FIG. 3 in order to increase the life of the 9 volt battery 42. If battery life is unimportant in the particular application, switch 50 may be left out.

While a specific embodiment of the invention has been shown and described in detail to illustrate the application of the principles of the invention, it will be understood that the invention may be embodied otherwise without departing from said principles.

What is claimed is:

1. A remote control adaptor for use with an electrical firing control signal generating detonator for controlling the actuation of a self-powered device comprising:

input terminal means for receiving an electrical firing control signal from a detonator;

output terminal means for connection to a self-powered device to be actuated;

switch means connected between said input terminal means and said output terminal means and being selectively operable to produce open-circuit and closed-circuit states at said output terminal means;

said switch means being operable in responsive to an electrical firing control signal applied to said input terminal means to produce a closed-circuit state at said output terminal means to thereby actuate a self-powered device connected thereacross; and indicator means connected to said switch means for generating a warning signal indicative of a closed-circuit state at said output terminal means prior to the connection of the self-powered device to the output terminal means as an indication of an unsafe connection condition.

2. The adaptor of claim 1 wherein:

said switch means includes a switch which operates in response to an electrical firing control signal applied to said input terminal means; and said indicator means includes an electrical power supply and a current indicator serially connected to said switch to form a closed circuit upon operation of said switch and thereby indicate a safe connection condition.

3. The adaptor of claim 2 further including:

a manually closable switch serially connected with said electrical power supply and said current indicator to prolong the life of the electrical power supply by enabling selective energization of said current indicator.

4. The adaptor of claim 3 wherein:

said current indicator is a light emitting diode.

5. The adaptor of claims 1 wherein:

said switch means is a relay which includes a solenoid coil connected across said input terminal means and operable in response to an application of the electrical firing control signal to said input terminal means, switch contacts connected across said output terminal means and being operable by said solenoid coil, and additional switch contacts serially connected to said indicator means and being operable by said solenoid coil; and said indicator means includes a serially connected electrical power supply and current indicator.

6. The adaptor of claim 5 wherein:

said additional switch contacts are a single-pole, double-throw switch operable between two switching states;

said indicator means is connected to said single-pole, double-throw switch and forms a closed circuit in one of said switching states; and further including another indicator means including another current indicator;

said another current indicator connected to said single-pole, double-throw switch and said electrical power supply to form a closed circuit in another of said switching states to thereby indicate a safe connection condition.

7. The adaptor of claim 6 wherein:

said current indicators are light emitting diodes;

said electrical power supply is a battery; and each of said indicator means includes a limiting resistor serially connected to said current indicator.

8. The adaptor of claim 6 wherein:

said switch means is a bistable impulse relay.

* * * * *